US011346192B2

(12) United States Patent
Hoelscher et al.

(10) Patent No.: US 11,346,192 B2
(45) Date of Patent: May 31, 2022

(54) PRESSURE ACTIVATED FIRING HEADS, PERFORATING GUN ASSEMBLIES, AND METHOD TO SET OFF A DOWNHOLE EXPLOSION

(71) Applicant: Halliburton Energy Services, Inc., Houston, TX (US)

(72) Inventors: Christopher C. Hoelscher, Arlington, TX (US); Mark D. Macek, Tyler, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/862,268

(22) Filed: Apr. 29, 2020

(65) Prior Publication Data

US 2021/0340845 A1 Nov. 4, 2021

(51) Int. Cl.
*E21B 43/1185* (2006.01)

(52) U.S. Cl.
CPC ..... *E21B 43/11852* (2013.01)

(58) Field of Classification Search
CPC ..... E21B 43/11852
See application file for complete search history.

(56) References Cited

U.S. PATENT DOCUMENTS 3,800,705 A * 4/1974 Tamplen ..... E21B 43/11855 102/222
4,484,632 A * 11/1984 Vann ..... E21B 43/116 166/297
4,564,076 A * 1/1986 Vann ..... E21B 43/11852 166/297
4,690,227 A * 9/1987 George ..... E21B 43/1185 175/4.54
4,886,127 A * 12/1989 Ricles ..... E21B 43/11852 175/4.54
5,603,384 A 2/1997 Bethel et al.
5,887,654 A * 3/1999 Edwards ..... E21B 23/04 166/297
7,350,448 B2 4/2008 Bell et al.
(Continued)

OTHER PUBLICATIONS

International Search Report and Written Opinion issued for corresponding International PCT Application No. PCT/US2020/031689, dated Jan. 21, 2021.

*Primary Examiner* — Shane Bomar
(74) *Attorney, Agent, or Firm* — McGuireWoods LLP

(57) ABSTRACT

The disclosed embodiments include pressure-activated firing heads, perforating gun assemblies, and methods to set off a downhole explosion. A pressure-activated firing head includes a first chamber and a second chamber having an energy storage element disposed within the second chamber. The pressure-activated firing head also includes a port fluidly connecting the first chamber and the second chamber. The pressure-activated firing head further includes a flow restrictor that restricts fluid flow from the second chamber to the first chamber. The pressure-activated firing head further includes a firing pin shiftable from a first position to a second position to strike an initiator. The pressure-activated firing head further includes a shear pin that holds the firing pin in the first position and configured to shear in response to a threshold pressure applied to the shear pin to release the firing pin from the first position.

20 Claims, 8 Drawing Sheets

(56) References Cited

U.S. PATENT DOCUMENTS

| | | | | |
|---|---|---|---|---|
| 8,763,507 | B2 * | 7/2014 | Ross | E21B 43/11852 89/1.15 |
| 2010/0206633 | A1 | 8/2010 | Moore et al. | |
| 2013/0098616 | A1 * | 4/2013 | Ross | E21B 43/11852 166/297 |
| 2013/0126167 | A1 | 5/2013 | Stolboushkin | |
| 2014/0137723 | A1 * | 5/2014 | Umphries | E21B 43/11855 89/1.15 |
| 2019/0162058 | A1 | 5/2019 | Preiss et al. | |
| 2019/0234189 | A1 * | 8/2019 | Preiss | E21B 23/04 |
| 2020/0182025 | A1 * | 6/2020 | Brady | E21B 43/11852 |
| 2021/0102433 | A1 * | 4/2021 | Robey | E21B 23/006 |

* cited by examiner

PRESSURE ACTIVATED FIRING HEADS, PERFORATING GUN ASSEMBLIES, AND METHOD TO SET OFF A DOWNHOLE EXPLOSION

BACKGROUND

The present disclosure relates generally to pressure-activated firing heads, perforating gun assemblies, and methods to set off a downhole explosion.

Perforating gun assemblies are sometimes used in wireline or tubing conveyed systems to perforate hydrocarbon production wells. Perforating gun assemblies sometime utilize charges or explosives that are set off to perforate the surrounding formation. After the perforating gun assemblies are lowered into a well to a zone of interest, the charges are set off to perforate the surrounding formation.

BRIEF DESCRIPTION OF THE DRAWINGS

Illustrative embodiments of the present disclosure are described in detail below with reference to the attached drawing figures, which are incorporated by reference herein, and wherein:

FIG. 2A' is a schematic, cross-sectional view of a firing head of a perforating gun assembly similar to the firing head of FIG. 2A and deployable in the wellbore of FIG. 1;

FIG. 3' is a schematic, cross-sectional view of a firing head of a perforating gun assembly similar to the firing head of FIG. 3 and deployable in the wellbore of FIG. 1.

Figure 1:
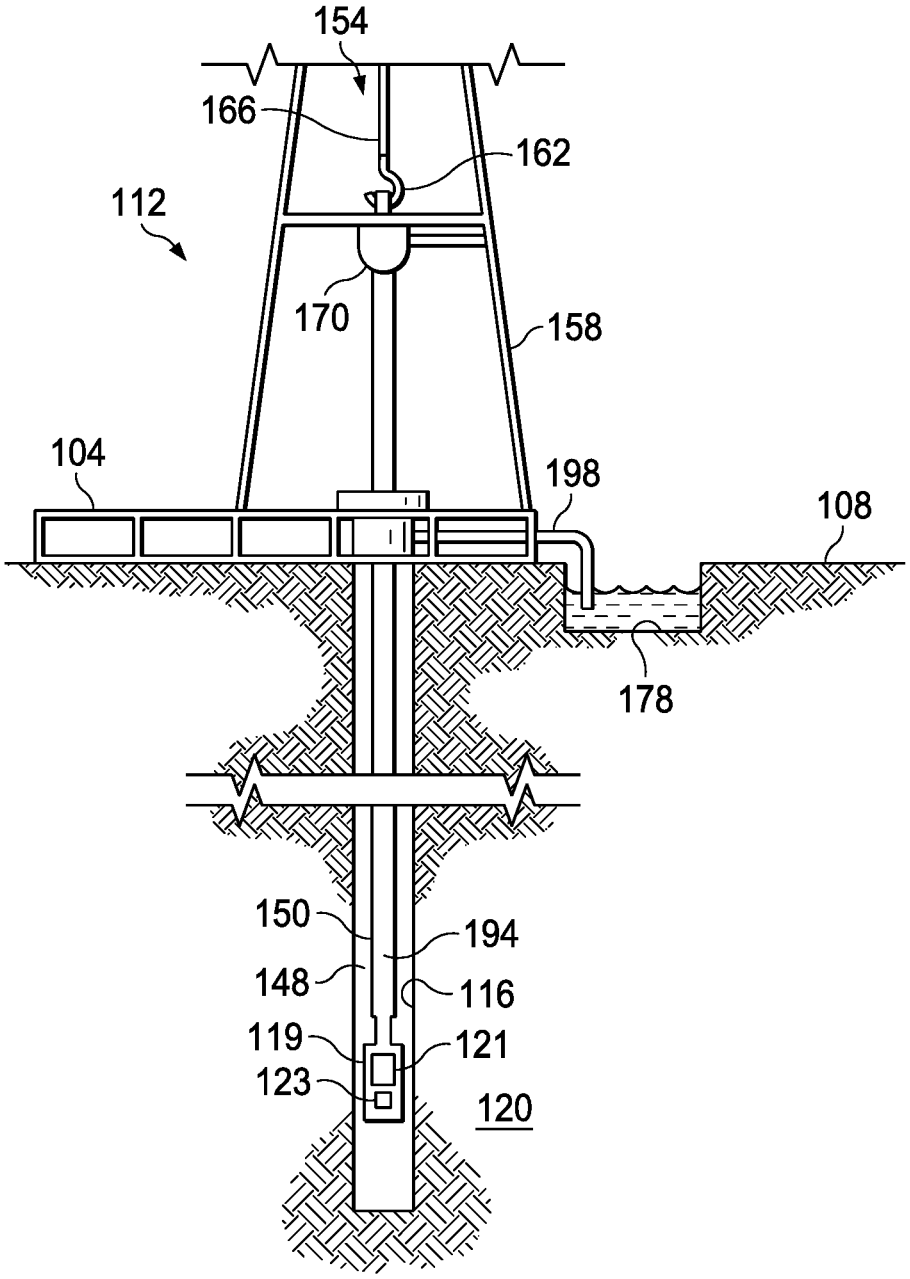
FIG. 1 is a schematic, side view of a well having a perforating gun assembly deployed in a wellbore of the well during a perforating operation.

The illustrated figures are only exemplary and are not intended to assert or imply any limitation with regard to the environment, architecture, design, or process in which different embodiments may be implemented.

DETAILED DESCRIPTION

The present disclosure relates to pressure-activated firing heads, perforating gun assemblies, and methods to set off downhole explosions. A pressure-activated firing head of a perforating gun assembly includes a first chamber (an annulus pressure chamber) and a second chamber (a high pressure chamber) that stores an energy storage element in the high pressure chamber. In some embodiments, the energy storage element is a spring and piston assembly that is configured to convert kinetic energy from fluids flowing into the high pressure chamber into potential energy by displacement of the spring. In some embodiments, the energy storage element includes a gas, such as nitrogen, that is pressurized to store energy for subsequent release. The annulus pressure chamber and the high pressure chamber are fluidly connected by a port having a restrictor positioned in or near the port. The restrictor is configured to allow fluid flow from the annulus pressure chamber through the port to the high pressure chamber, and reduce or prevent fluid flow from the high pressure chamber through the port to the annulus pressure chamber. In some embodiments, the restrictor is a check valve. In some embodiments, the restrictor is an inflow control device or an autonomous inflow control device. The pressure-activated firing head also includes a firing pin that is shiftable from a first position to a second position to strike an initiator of the perforating gun assembly to initiate firing of the perforating gun assembly or to set off one or more wellbore isolation devices (such as packers). In some embodiments, the firing pin is initially positioned between the high pressure chamber and the annulus pressure chamber, and subsequently shifts into and through the annulus pressure chamber to strike the initiator of the perforating gun assembly. In one or more of such embodiments, the firing pin includes a piston that is initially sheared in place by the shears, or pinned in place by the shear pins or screws.

In some embodiments, the firing pin is initially held in position by one or more shear pins that are configured to shear in response to a threshold amount of pressure (such as 1 k psi, 10 k psi, or a different amount of pressure) applied to the shear pin. After shearing of the shear pin, fluid pressure from fluids in the high pressure chamber shifts the firing pin to strike the initiator. In some embodiments, a rupture disc that ruptures at a threshold pressure is positioned between the firing pin and the high pressure chamber. In one or more of such embodiments, the rupture disc is configured to rupture in response to a threshold amount of pressure applied to the rupture disc. In one or more of such embodiments, after rupturing of the rupture disc, fluid pressure from fluids in the high pressure chamber shifts the firing pin to strike the initiator. In some embodiments, screws that shear at a threshold pressure, as well as other types of tools, members, or devices that initially prevent fluid pressure from shifting the firing pin until the fluid pressure is above the threshold amount of pressure are utilized in lieu of the shearing pin or the rupture disc.

In some embodiments, the pressure-activated firing head has a second port that provides fluid communication from a annular region (annulus) outside of the perforating gun assembly to the annulus pressure chamber, and a rupture disc that is configured to rupture to allow fluid flow from the annulus into the firing head in response to a second threshold pressure applied to the rupture disc. In one or more of such embodiments, the rupture disc initially covers the second port to prevent fluid flow into the annulus pressure chamber. In one or more of such embodiments, the rupture disc is configured to rupture at a predetermined pressure experienced at a desired deployment zone or depth. Moreover, the rupture disc initially prevents fluid flow into the annulus pressure chamber while the perforating gun assembly is being deployed. After the perforating gun assembly is deployed in the desired zone or at the desired depth, pressure experienced at the desired zone or depth applied to the rupture disc ruptures the rupture disc, and fluids from an annulus of a wellbore outside of the perforating gun assembly flow through the second port into the annulus pressure chamber. The fluids also flow through the port and into the high pressure chamber. The restrictor permits one direction flow into the high pressure chamber. The high pressure chamber is eventually filled with a threshold amount or is completely filled with fluids. The fluids that fill the high pressure chamber also transfer kinetic energy to the energy storage element (such as the spring of a piston assembly).

After a threshold amount of kinetic energy is transferred to the energy storage element, one or more operations are performed to decrease pressure outside of the high pressure chamber. However, the restrictor prevents fluids in the high pressure chamber from flowing into the annulus, thereby maintaining fluid pressure in the high pressure chamber. As the fluids in the annulus pressure chamber decrease, the differential pressure between the high pressure chamber and the annulus pressure chamber increases until the differential pressure is at or above the threshold pressure, which is the threshold shearing pressure of the one or more shear pins that initially hold the firing pin in place, thereby shearing the shear pins. After shearing of the shear pins, potential energy stored in the energy storage element and the force of the fluids stored in the high pressure chamber are applied to the firing pin and shifts the firing pin to strike the initiator, thereby initiating firing of the perforating gun assembly.

In some embodiments where a rupture disc configured to rupture in response to a threshold pressure is initially positioned between the high pressure chamber and the firing head, increasing the differential pressure above the threshold pressure ruptures the rupture disc, thereby allowing fluids in the high pressure chamber to flow onto the firing pin. In such embodiments, after rupturing of the rupture disc, potential energy stored in the energy storage element and the force of the fluids stored in the high pressure chamber are applied to the firing pin and shifts the firing pin to strike the initiator, thereby initiating firing of the perforating gun assembly.

In some embodiments, the pressure-activated firing head includes a firing pin interrupter (such as a safety pin) that initially prevents premature firing of the perforating gun assembly before the perforating gun assembly is deployed at a desired zone or depth, where the firing pin interrupter is any mechanical, electrical, hydraulic, electromechanical, or similar device or mechanism that prevents premature firing of the firing pin. In some embodiments, after the perforating gun assembly is deployed at the desired zone or depth, and the rupture disc that initially covered the second port has ruptured to provide fluid communication into the annulus pressure chamber, pressure applied by fluids flowing into the annulus pressure chamber shifts the safety pin from a first position that initially prevents movement of the firing pin to a second position that permits movement of the firing pin. Additional descriptions of the firing pin and the safety pin are provided in the paragraphs below and are illustrated in at least FIGS. 2A-2C.

In some embodiments, the perforating gun assembly includes a sleeve (such as a deactivation sleeve) and multiple ports that are fluidly connected to the annulus pressure chamber, the high pressure chamber, and an annulus outside of the perforating gun assembly. In one or more of such embodiments, the deactivation sleeve is initially in a first position that covers the foregoing ports. Further, the deactivation sleeve is shiftable to a second position that does not cover the ports. In one or more of such embodiments, fluids flowing through the uncovered ports into the annulus pressure chamber shift the safety pin back to the first position to prevent movement of the firing pin. In one or more of such embodiments, fluids flowing through the uncovered ports also establish pressure equilibrium in the first and second chambers. In one or more of such embodiments, establishing pressure equilibrium in the first and second chambers also shifts the safety pin back to the first position to prevent movement of the firing pin. Additional descriptions of the deactivation sleeve and methods to shift the deactivation sleeve to cover or uncover the ports are provided in the paragraphs below and are illustrated in at least FIGS. 2A-2C. Further, additional descriptions of pressure-activated firing heads, perforating gun assemblies, and methods to set off a downhole explosion are described in the paragraphs below and are illustrated in FIGS. 1-4.

Now turning to the figures, FIG. 1 illustrates a schematic view of a well 112 having a perforating gun assembly 119 deployed in a wellbore 116 during well completion to perforate wellbore 116 and form or enhance perforations in the surrounding formation 120. Well 112 includes wellbore 116 that extends from surface 108 of well 112 to a subterranean substrate or formation 120. Well 112 and rig 104 are illustrated onshore in FIG. 1. Alternatively, the operations described herein and illustrated in the figures are performed in an off-shore environment.

In the embodiment illustrated in FIG. 1, wellbore 116 has been formed by a drilling process in which dirt, rock and other subterranean materials are removed to create wellbore 116. In some embodiments, a portion of wellbore 116 is cased with a casing (not illustrated). In other embodiments, wellbore 116 is maintained in an open-hole configuration without casing. The embodiments described herein are applicable to either cased or open-hole configurations of wellbore 116, or a combination of cased and open-hole configurations in a particular wellbore.

After drilling of wellbore 116 is complete and the associated drill bit and drill string are "tripped" from wellbore 116, a conveyance 150, which may be a drill string, drill pipe, coiled tubing, production tubing, wireline, downhole tractor or another type of conveyance deployable in a wellbore, is lowered into wellbore 116. In some embodiments, conveyance 150 includes an interior 194 disposed longitudinally in conveyance 150 that provides fluid communication between the surface 108 of well 112 of FIG. 1 and a downhole location in formation 120, where conveyance 150 provides a fluid flow path for fluids to flow into an annulus 148 exterior of perforating gun assembly 119, and from annulus 148 uphole, where the fluid flows uphole, through an outlet conduit 198, and into a container 178. In some embodiments, where conveyance 150 is a wireline, wellbore 116 provides fluid flow paths for fluids to flow downhole to annulus 148 and uphole from annulus 148 to container 178. In some embodiments, one or more pumps (not shown) are utilized to facilitate fluid flow downhole or uphole.

In the embodiment of FIG. 1, conveyance 150 is lowered by a lift assembly 154 associated with a derrick 158 positioned on or adjacent to rig 104 as shown in FIG. 1. Lift assembly 154 includes a hook 162, a cable 166, a traveling block (not shown), and a hoist (not shown) that cooperatively work together to lift or lower a swivel 170 that is coupled to an upper end of conveyance 150. In some embodiments, conveyance 150 is raised or lowered as needed to add additional sections of tubing to conveyance 150 to position perforating gun assembly 119 at a desired depth or zone in wellbore 116.

Perforating gun assembly 119 includes a pressure-activated firing head 121 (shown in FIGS. 2A-2C and 3 and described herein) configured to strike an initiator 123 to initiate firing of perforating gun assembly 119 into formation 120. In some embodiments, after firing of perforating gun assembly 119, perforating gun assembly 119 is lowered or lifted to another location or zone in wellbore 116 to initiate firing of the perforating gun assembly 119 in the second location or zone. In some embodiments, perforating gun assembly 119 is lifted to surface 108 without firing into formation 120. Additional descriptions of perforating gun assembly 119, firing head 121, and operations performed to strike or prevent striking of initiator 123 are provided in the paragraphs below and are illustrated in FIGS. 2A-2C, 3, and 4.

Although FIG. 1 depicts conveyance 150 as a tubing having an interior 194, in some embodiments, conveyance 150 is a wireline. Further, although FIG. 1 illustrates a vertical wellbore, in some embodiments, perforating gun assembly 119 and the operations described herein are performed in a horizontal wellbore, a diagonal wellbore, a curved wellbore or a tortuous shaped wellbore. Further, although FIG. 1 illustrates one perforating gun assembly 119, in some embodiments, multiple perforating gun assemblies (not shown) are deployed by conveyance 150 to different desirable depths. In one or more of such embodiments, the multiple perforating gun assemblies are simultaneously or sequentially initiated to simultaneously or sequentially fire into formation 120.

Figure 2A:
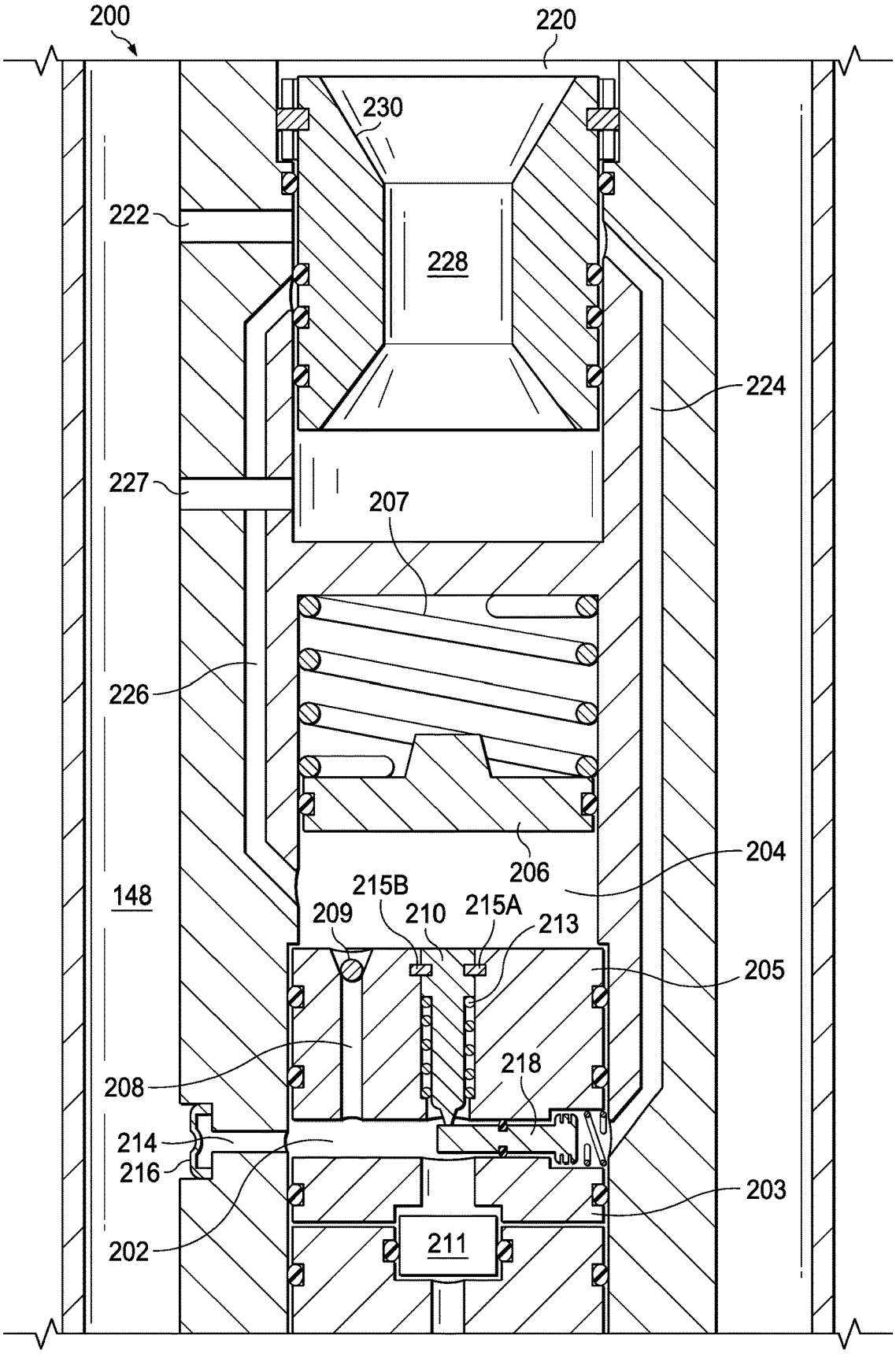
FIG. 2A is a schematic, cross-sectional view of a firing head of the perforating gun assembly of FIG. 1.
Figure 2A:
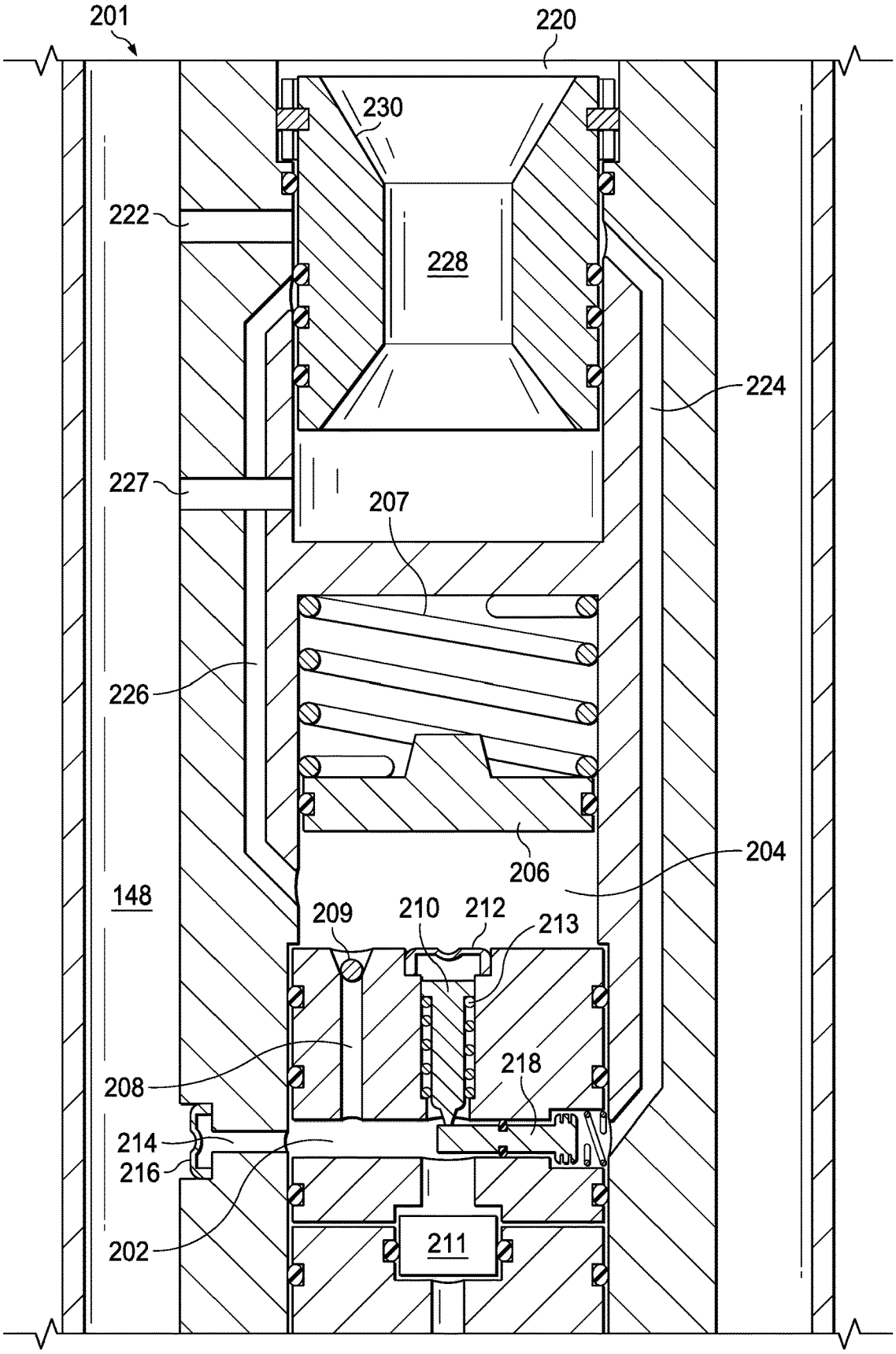

FIG. 2A is a schematic, cross-sectional view of a firing head 200 of perforating gun assembly 119 of FIG. 1. Firing head 200 has a first chamber 202 and a second chamber 204 that houses an energy storage element 206 in second chamber 204. In the embodiment of FIG. 2A, energy storage element 206 includes a piston coupled to a spring 207 above the piston. The piston is reciprocable within the second chamber 204 in response to a change in fluid pressure within the second chamber 204, such as to move the piston 206 upward to compress the spring 207 in response to an increase in fluid pressure. In other embodiments, energy storage element 206 may alternatively, or additionally, include a gas such as nitrogen in the space above the piston 206 that may be pressurized to store energy. An enclosed volume defined within the second chamber 204 between a lower surface of the piston 206 and an upper surface of a firing pin housing 205 is variable depending on position of the piston 206. A compressible fluid (e.g. a gas) may be captured therein. Another enclosed volume is defined in the first chamber 202 between a lower end of firing pin housing 205 and an upper end of safety pin housing 203. An activation port 214, which when open provides fluid communication from an annulus outside of firing head 200, such as annulus 148, to first chamber 202, is closed by a rupture disc 216 up to an activation pressure that corresponds to a pressure at a desired depth. Meanwhile, pressure in the enclosed volume of the second chamber 204 urges a flow restrictor 209 into a closed position. The flow restrictor 209 may be any of a variety of flow control elements, such as a one-way valve depicted by way of example here as a valve element engaged with a valve seat when under positive pressure within the second chamber 204. (Other examples include an element of flow restrictor 209 disposed inside port 208 or near an outlet of port 208. In some examples, port 208 is connected to port 214. In some examples, ports 208 and 214 form a single port.) In that regard, the first chamber 202 and the second chamber 204 are initially fluidly sealed while the perforating gun assembly 119 of FIG. 1 is deployed, at least up to a desired depth or zone, as further discussed below.

In FIG. 2A, rupture disc 216 configured to rupture in response to a sufficient pressure applied to rupture disc 216, which is typically less than a failure of other elements (e.g. seals) designed to withstand that same pressure. Rupture disc 216 may be selected to rupture in response to a threshold pressure corresponding to a desired depth. Upon rupture of rupture disc 216, the activation port 214 is open to allow downhole fluid in annulus 148 to flow through port 214 into the first chamber 202 and up through the port 208 past the flow restrictor 209 and into the second chamber 204. Additionally, fluid flowing into the first chamber 202 may apply pressure to a firing pin interrupter 218 sealed within an internal bore, to urge the firing pin interrupter 218 from a first position shown in FIG. 2A that helps prevent the firing pin 210 from moving downward, to a second position shown in FIG. 2B that is out of the way of the firing pin 210. As discussed in further detail below, the firing pin 210 will initially be retained by firing pin retention members 215A, 215B after moving firing pin interrupter 218 out of the way of the firing pin 210, to prevent firing, but firing pin retention members 215A and 215B may shear in response to application of an additional pressure in the second chamber 204 when it is desired to fire the gun.

Referring further to the firing head 200, the firing pin 210 is coupled to a spring 213 while firing pin 210 is in the position illustrated in FIG. 2A. Moreover, firing pin 210 is initially held in a first position shown in FIG. 2A by spring 213. In some embodiments, firing head 200 does not include spring 213.

In some embodiments, firing pin 210 is coupled to a shearable member (not shown) instead of spring 213 while firing pin 210 is in the position illustrated in FIG. 2A. In such embodiments, firing pin 210 is initially held in the first position shown in FIG. 2A by the shearable member. In some embodiments, firing pin 210 also includes a piston (not shown). In the embodiment of FIG. 2A, firing pin interrupter 218 is shiftable (such as to a position illustrated in FIG. 2B) to permit movement of firing pin 210 from the position illustrated in FIG. 2A downward to strike an initiator 211 to initiate firing of perforating gun assembly 119 of FIG. 1. Additional descriptions of shifting firing pin 210 and firing pin interrupter 218 are provided in the paragraphs below.

Figure 2B:
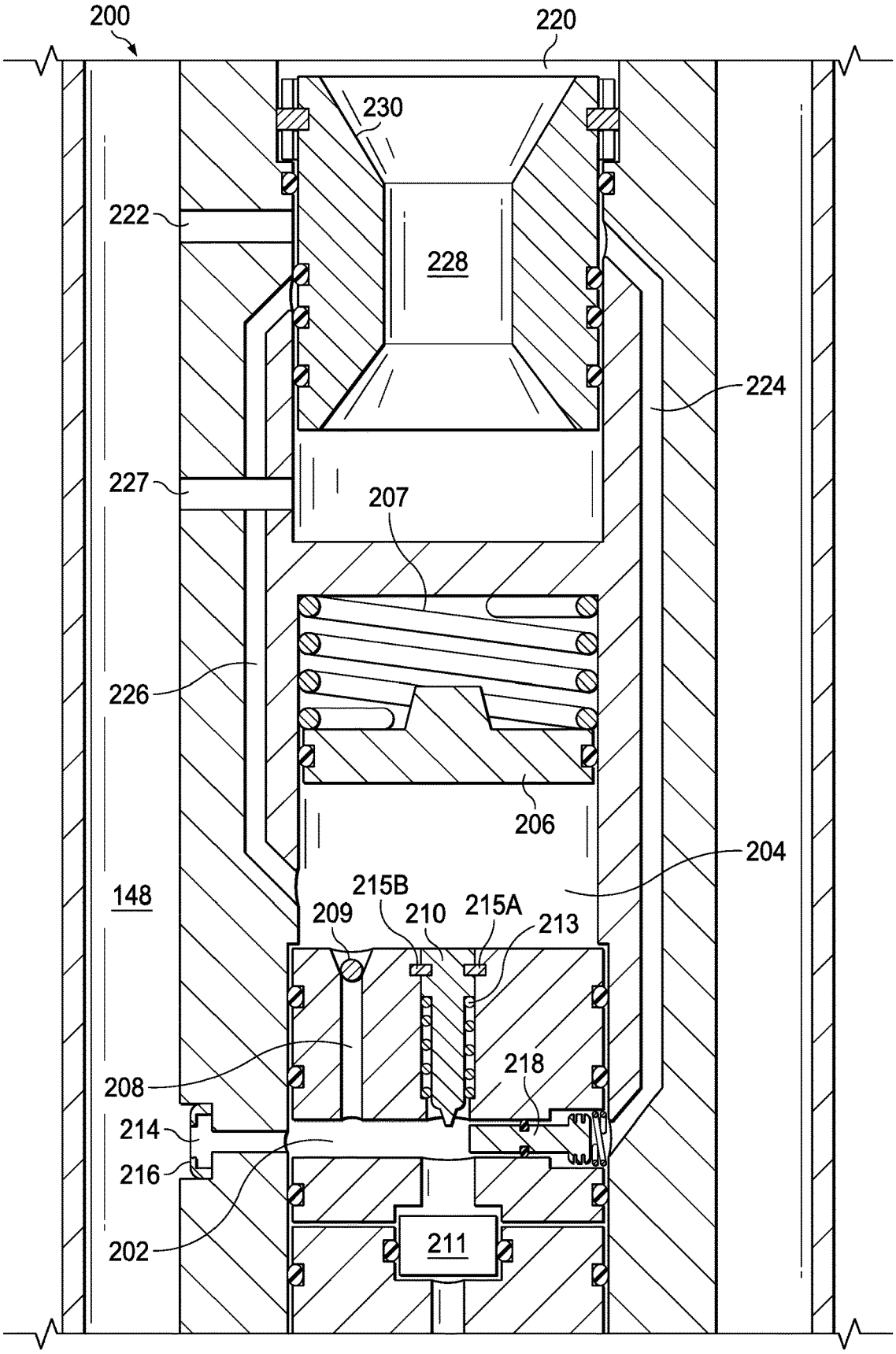
FIG. 2B is a schematic, cross-sectional view of the firing head of FIG. 2A after a firing pin interrupter is shifted to a second position to permit movement of a firing pin.
Figure 2C:
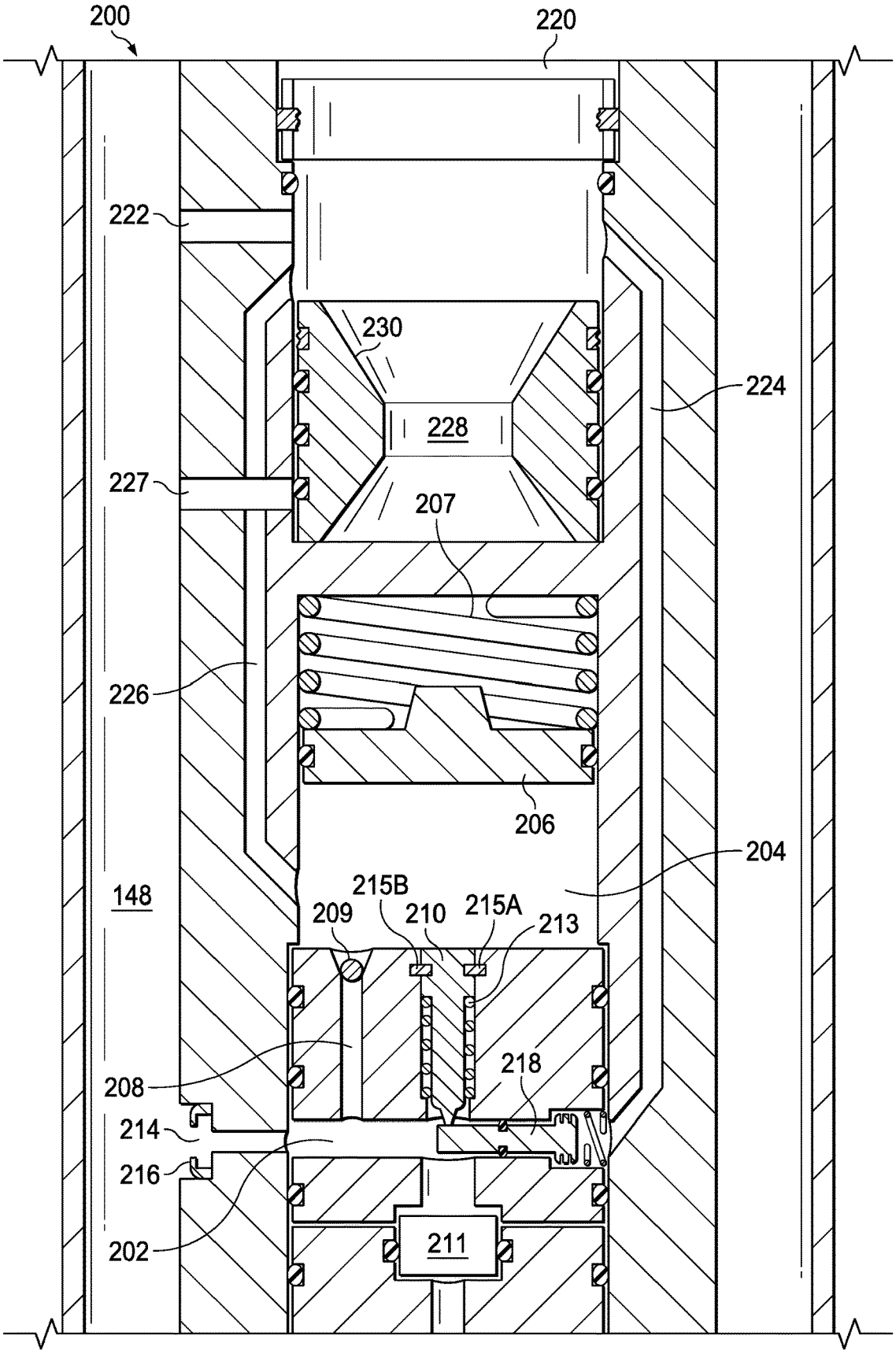
FIG. 2C is a schematic, cross-sectional view of the firing head of FIG. 2B after a sleeve is shifted from a first position to a second position to shift the firing pin interrupter from the second position to the first position.

Firing head 200 also includes firing pin retention members 215A and 215B. In the embodiment of FIGS. 2A-2C, firing pin retention members 215A and 215B are shear pins that initially hold firing pin 210 in the position illustrated in FIG. 2A. Further, firing pin retention members 215A and 215B shear in response to a threshold pressure (such as 1 k psi, 5 k psi, 10 k psi, or a different amount of pressure) applied to the members to prevent pressure from energy storage element 206 or the fluids in second chamber 204 from being prematurely applied to firing pin 210. More particularly, when perforating gun assembly 119 of FIG. 1 is initially deployed downhole, rupture disc 216 is intact to prevent fluid communication into first chamber 202 and second chamber 204. Rupture disc 216 is configured to rupture in response to a threshold pressure experienced at a desired depth or zone. After perforating gun assembly 119 reaches the desired depth or zone, pressure at the desired depth or zone ruptures rupture disc 216, and fluids from annulus 148 flow through port 214 into first chamber 202.

Fluids flowing into first chamber 202 apply a force to firing pin interrupter 218 and shifts firing pin interrupter 218 from a first position shown in FIG. 2A to a second position shown in FIG. 2B to permit movement of firing pin 210 towards initiator 211. However, in the embodiment of FIG. 2A, firing pin 210 is initially also held in place by firing pin retention members 215A and 215B, which are configured to shear in response to a threshold amount of pressure applied to firing pin retention members 215A and 215B.

Further, fluids flowing into first chamber 202 also flow from port 208 into second chamber 204. However, flow restrictor 209 prevents fluid flow from second chamber 204 through port 208 back into first chamber 202. As more fluids flow into second chamber 204, a force from the fluids is applied to energy storage element 206. In the embodiment of FIG. 2A, spring 207 is compressed to store potential energy. After second chamber 204 is filled by a threshold amount of fluids (such as completely filled, 90% filled, or filled to a different volume), a pumping operation is performed to reduce the fluid pressure in first chamber 202. In some embodiments, the pumping operation is performed after a threshold amount of energy is stored in energy storage element 206. During the pumping operation, fluid pressure outside second chamber 204 is decreased. However, flow restrictor 209 prevents fluid flow from second chamber 204 through port 208 into first chamber 202, thereby causing an increase in differential pressure between first chamber 202 and second chamber 204. As the differential pressure between first chamber 202 and second chamber 204 increases to a level at or above the threshold pressure of firing pin retention members 215A and 215B that causes firing pin retention members 215A and 215B to shear, the differential pressure shears firing pin retention members 215A and 215B, thereby allowing fluid pressure on firing pin 210 to shift firing pin 210 from the position illustrated in FIG. 2A towards initiator 211. Energy stored in energy storage element 206 is released (such as energy released by spring 207 returning to a natural position), and the released energy shifts firing pin 210 towards initiator 211 to initiate firing of perforating gun assembly 119.

Firing head 200 includes a shiftable sleeve 228 disposed in a location 220 above second chamber 204. Firing head 200 also includes a third port 222 that provides fluid communication to an annulus outside of perforating gun assembly 119 of FIG. 1, such as annulus 148. Firing head 200 also includes a fourth port 224 that is fluidly connected to first chamber 202, a fifth port 226 that is fluidly connected to second chamber 204, and a sixth port 227 that is fluidly connected to annulus 148. In the embodiment of FIG. 2A, sleeve 228 is in a first position that covers third port 222, fourth port 224, and fifth port 226, thereby preventing fluid flow from location 220 via third port 222, fourth port 224, and fifth port 226. Further, while sleeve 228 is in the first position, sixth port 227 is not covered by sleeve 228. Sleeve 228 is coupled to or is positioned near a seat 230 that is configured to catch a diverter deployed into an interior area of firing head 200 or an interior area of perforating gun assembly 119. In the embodiments of FIGS. 2A to 2C, force from a diverter (such as a ball, a plug, or a bar) landing on seat 230 shifts sleeve 228 to a second position (such as the position shown in FIG. 2C) to uncover third port 222, fourth port 224, and fifth port 226, and to cover sixth port 227. Additional descriptions of operations performed to shift sleeve 228 are provided in the paragraphs below.

FIG. 2A' is a schematic, cross-sectional view of a firing head of a perforating gun assembly 201 similar to firing head 200 of FIG. 2A and deployable in wellbore 116 of FIG. 1. The perforating gun assembly of FIG. 2A' includes first chamber 202, second chamber 204, energy storage element 206, spring 207, port 208, flow restrictor 209, firing pin 210, initiator 211, spring 213, port 214, rupture disc 216, firing pin interrupter 218, third port 222, fourth port 224, fifth port 226, sixth port 227, sleeve 228, and diverter seat 230 that are identical to first chamber 202, second chamber 204, energy storage element 206, spring 207, port 208, flow restrictor 209, firing pin 210, initiator 211, spring 213, port 214, rupture disc 216, firing pin interrupter 218, third port 222, fourth port 224, fifth port 226, sixth port 227, sleeve 228, and diverter seat 230 as illustrated in FIG. 2A, respectively, which are described in the paragraphs herein. Further, firing head 200 also includes another rupture disc 212 positioned between second chamber 204 and firing pin 210. In the embodiment of FIG. 2A', rupture disc 212 ruptures at a threshold pressure (such as 1 k psi, 5 k psi, 10 k psi, or a different amount of pressure) to prevent pressure from energy storage element 206 or the fluids in second chamber 204 from being prematurely applied to firing pin 210.

FIG. 2B is a schematic, cross-sectional view of firing head 200 of FIG. 2A after firing pin interrupter 218 is shifted to a second position to permit movement of firing pin 210. In the embodiment of FIG. 2B, a force from fluids flowing and filling up second chamber 204 compresses spring 207 of energy storage element 206, thereby storing potential energy in the compressed state of spring 207. In the embodiment of FIG. 2B, rupture disc 216 has ruptured after perforating gun assembly 119 of FIG. 1 is deployed at a desired depth or zone. In some embodiments, a sensor (not shown) detects rupturing of rupture disc 216, and firing pin interrupter 218 electronically, electro-mechanically, mechanically, or hydraulically shifts from the position illustrated in FIG. 2A to the position illustrated in FIG. 2B to permit movement of firing pin 210. In some embodiments, a sensor (not shown) detects presence of fluids in first chamber 202, and firing pin interrupter 218 electronically, electro-mechanically, mechanically, or hydraulically shifts from the position illustrated in FIG. 2A to the position illustrated in FIG. 2B to permit movement of firing pin 210. After firing pin interrupter 218 has shifted to the position illustrated in FIG. 2B, firing pin 210 is no longer prevented from shifting towards initiator 211 to initiate firing of perforating gun assembly 119. In some embodiments, firing pin interrupter 218 is configured to shift from the position illustrated in FIG. 2A to the position illustrated in FIG. 2B before shearing of firing pin retention members 215A and 215B, and fluid communication from second chamber 204 to first chamber 202 is established.

In some embodiments, after perforating gun assembly 119 of FIG. 1 is deployed downhole, perforating gun assembly 119 is subsequently lifted uphole or redeployed to another downhole location. In one or more of such embodiments, fluid communication to first chamber 202 is established to prevent misfiring of perforating gun assembly 119 of FIG. 1. In that regard, FIG. 2C is a schematic, cross-sectional view of the firing head of FIG. 2B after sleeve 228 is shifted from a first position shown in FIG. 2B to a second position shown in FIG. 2C to shift firing pin interrupter 218 from the position illustrated in FIG. 2B to the position illustrated in FIG. 2C to prevent movement of firing pin 210. In the embodiment of FIG. 2C, a diverter (such as a ball, a plug, or a bar) is deployed to location 220, where diverter is any tool or component that is deployable on seat 230 to shift sleeve 228. A force generated from the landing of the diverter on seat 230 shifts sleeve 228 from the position illustrated in FIG. 2B to the position illustrated in FIG. 2C, thereby uncovering third port 222, fourth port 224, and fifth port 226, and covering sixth port 227. Fluids flowing from outside of perforating gun assembly 119 of FIG. 1, such as from annulus 148, flow though third port 222 to location 220 of firing head 200. The fluids then flow through fourth port 224 into first chamber 202, and through fifth port 226 to second chamber 204. A force generated from fluids flowing into fourth port 224 shifts firing pin interrupter 218 from the position illustrated in FIG. 2B to the position illustrated in FIG. 2C to prevent movement of firing pin 210 towards initiator 211. In some embodiments, fluids flowing through fourth port 224 and fifth port 226 also establish pressure equilibrium in first chamber 202 and second chamber 204, thereby preventing shearing of firing pin retention members 215A and 215B.

In some embodiments, sleeve 228 is electronically, electromechanically, or hydraulically shifted from the position shown in FIG. 2B to the position shown in FIG. 2C. In some embodiments, sleeve 228 is shifted in a different direction to uncover third port 222, fourth port 224, fifth port 226, and sixth port 227. Although FIGS. 2A-2C illustrate two firing pin retention members 215A and 215B, in some embodiments, a different number of shear pins or other types of firing pin retention members initially hold firing pin 210 in the position as illustrated in FIG. 2A. Although FIGS. 2A-2C illustrate sleeve 228 disposed above second chamber 204, in some embodiments, sleeve 228 is disposed below first chamber 202 or second chamber 204. Further, in some embodiments, one or more components of firing head 200 or perforating gun assembly 119 of FIG. 1 are disposed between sleeve 228 and second chamber 204. Further, in some embodiments, sleeve 228 and firing head 200 are separate components of perforating gun assembly 119. Further, although FIGS. 2A-2C illustrate energy storage element 206 as a piston that is coupled to spring 207, in some embodiments, energy storage element 206 is a pressurized gas (not shown) such as nitrogen. In one or more of such embodiments, energy stored in the pressurized gas is subsequently released to apply pressure to shear firing pin retention members 215A and 215B. Further, although the embodiment illustrated in FIGS. 2A-2C include rupture disc 216, in some embodiments, rupture disc 216 is not present in firing head 200. In the embodiment of FIGS. 2A-2C, firing pin housing 205 and safety pin housing 203 are components of a single block. In some embodiments, firing pin housing 205 and safety pin housing 203 are different blocks within firing head 200.

Figure 3:
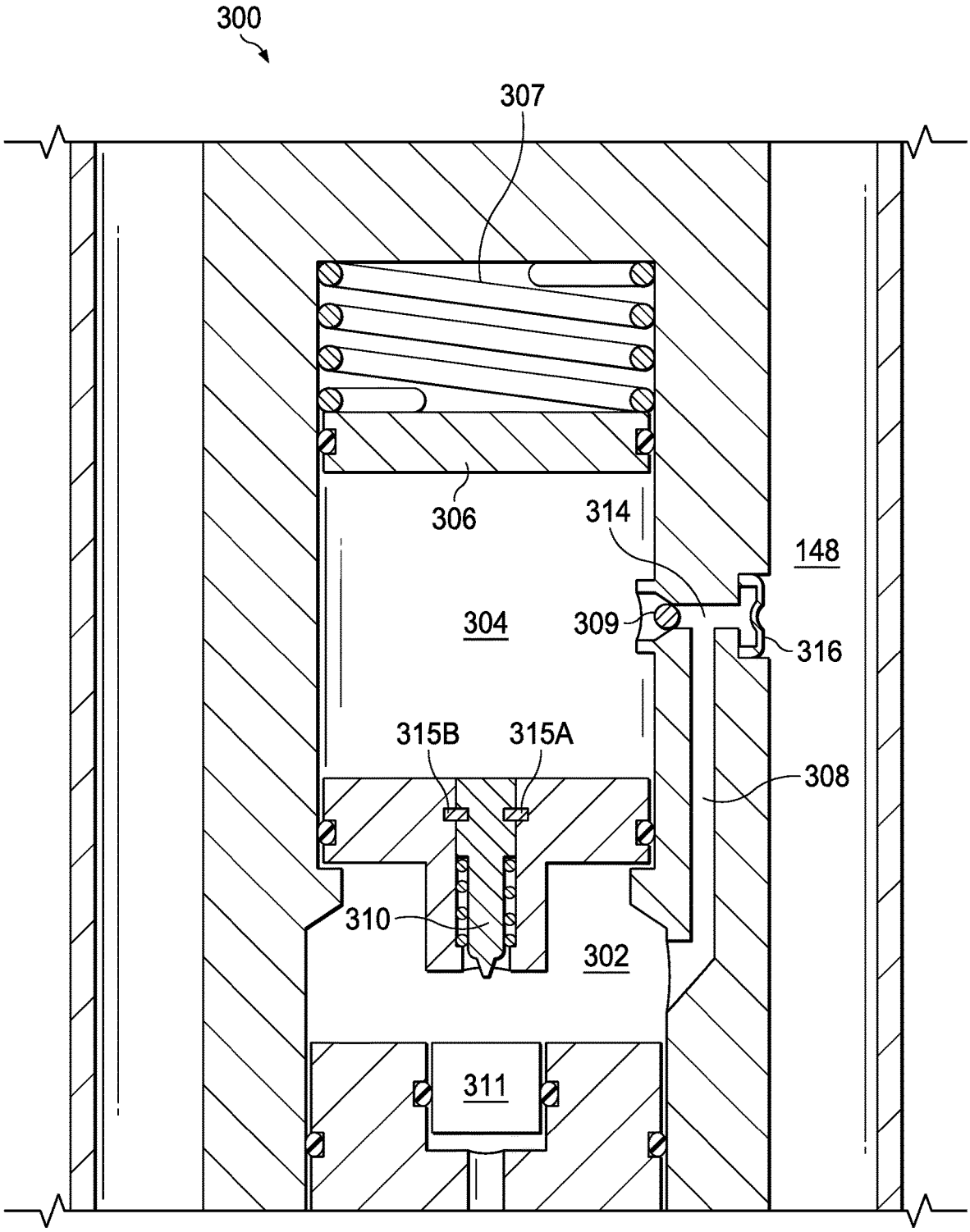
FIG. 3 is a schematic, cross-sectional view of another firing head of the perforating gun assembly of FIG. 1.
Figure 3:
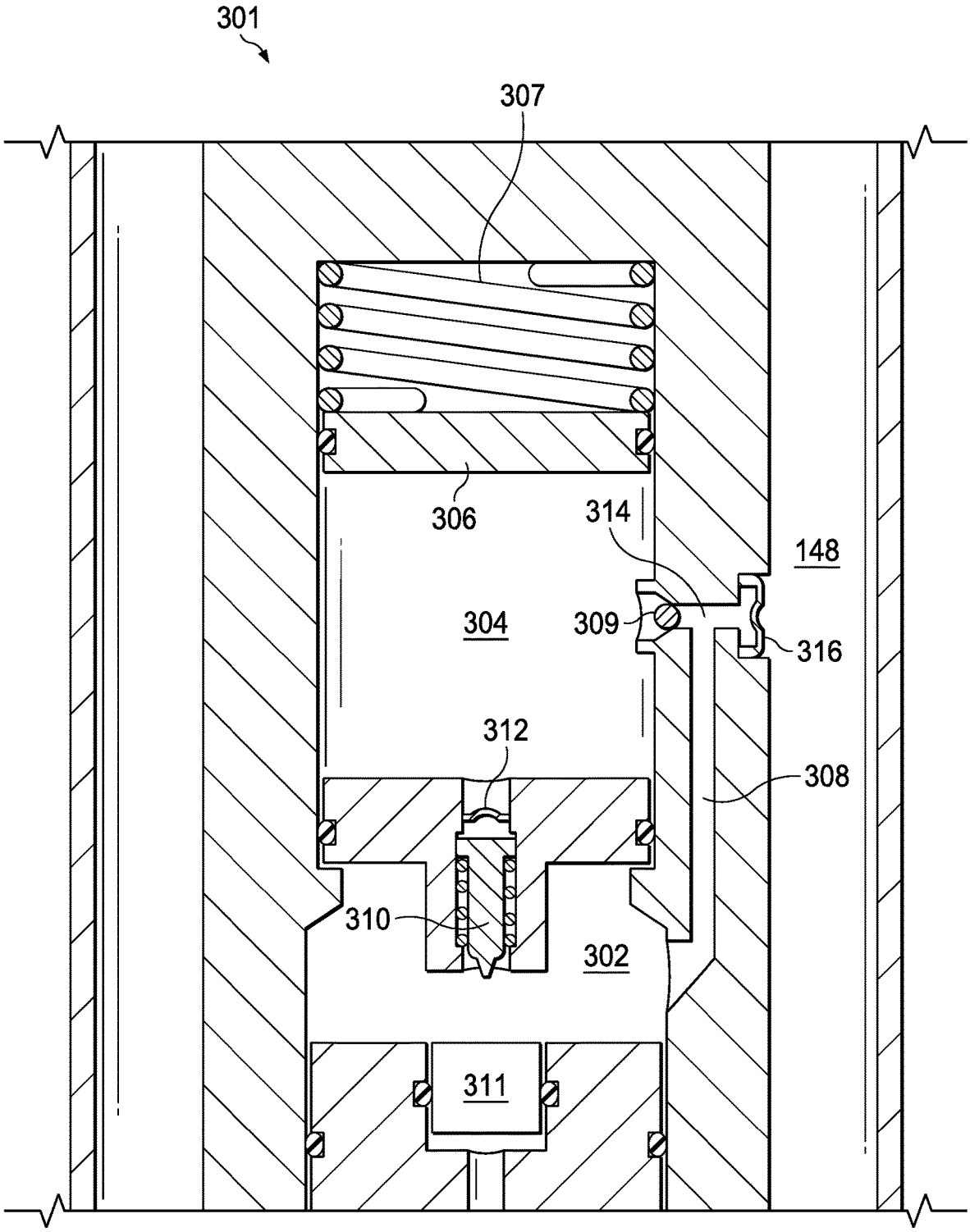

FIG. 3 is a schematic, cross-sectional view of another firing head 300 of perforating gun assembly 119 of FIG. 1. Firing head 300 has a first chamber 302 and a second chamber 304 that stores an energy storage element 306 in second chamber 304. In the embodiment of FIG. 3, similar to the embodiment of FIG. 2A, energy storage element 306 is a piston that is coupled to a spring 307. A port 314 provides fluid communication from an annulus outside of firing head 300, such as annulus 148, to first chamber 302. In the embodiment of FIG. 3, a rupture disc 316 configured to rupture in response to a threshold pressure applied to the rupture disc initially covers port 314 to prevent fluid flow through port 314 into first chamber 302. In that regard, first chamber 302 and second chamber 304 are initially fluidly sealed until perforating gun assembly 119 is deployed at a desired depth or zone.

A port 308 provides fluid communication between first chamber 302 and second chamber 304. A restrictor 309 that is configured to permit fluid flow into second chamber 304, and prevent fluid flow out of second chamber 304 is fluidly coupled to port 314. In some embodiments, restrictor 309 is disposed inside port 314 or is disposed near an outlet of port 314. In some embodiments, port 308 is connected to port 314. In some embodiments, ports 308 and 314 form a single port.

Firing head 300 includes a firing pin 310 that is initially in a first position shown in FIG. 3. Firing pin 310 is shiftable from the first position illustrated in FIG. 3 to a second position towards or at an initiator 311 to initiate firing of perforating gun assembly 119 of FIG. 1. Firing head 300 also includes firing pin retention members 315A and 315B that initially hold firing pin 310 in a position illustrated in FIG. 3A. Firing pin retention members 315A and 315B shear in response to a threshold pressure applied to firing pin retention members 315A and 315B to prevent pressure from energy storage element 306 or the fluids in second chamber 304 from being prematurely applied to firing pin 310. More particularly, when perforating gun assembly 119 of FIG. 1 is initially deployed downhole, rupture disc 316 is intact to prevent fluid communication into first chamber 302 and second chamber 304. As stated herein, rupture disc 316 ruptures at a threshold pressure experienced at a desired depth or zone. After perforating gun assembly 119 of FIG. 1 reaches the desired depth or zone, pressure at the desired depth or zone ruptures rupture disc 316, and fluids from annulus 148 flow through port 314 and port 308 into first chamber 302, and from port 314 into second chamber 304. However, restrictor 309 prevents fluid flow out of second chamber 304. As more fluids flow into second chamber 304, a force from the fluids is applied to energy storage element 306. In the embodiment of FIG. 3, spring 307 is compressed to store potential energy. After second chamber 304 is filled by a threshold amount of fluids (such as completely filled, 90% filled, or filled to a different volume), a pumping operation is performed to expel fluids in annulus 148. In some embodiments, the pumping operation is performed after a threshold amount of energy is stored in energy storage element 306. During the pumping operation, pressure outside first chamber 302 is reduced. In some embodiments, pressure in first chamber 302 is at equilibrium or approximately equilibrium with pressure in annulus 148. However, restrictor 309 prevents fluid flow out of second chamber 304, thereby causing an increase in differential pressure between first chamber 302 and second chamber 304. As the differential pressure between first chamber 302 and second chamber 304 increases to a level at or above the threshold pressure of firing pin retention members 315A and 315B, the differential pressure causes firing pin retention members 315A and 315B to shear, thereby allowing fluid pressure to shift firing pin 310 from the position illustrated in FIG. 3A towards initiator 311. Energy stored in energy storage element 306 is released (energy released by spring 307 returning to a natural position), and the released energy shifts firing pin 310 towards initiator 311 to initiate firing of perforating gun assembly 119 of FIG. 1. Although FIG. 3 illustrates two firing pin retention members 315A and 315B, in some embodiments, a different number of shear pins or other types of firing pin retention members initially hold firing pin 310 in the position as illustrated in FIG. 3. Further, although the embodiment illustrated in FIG. 3 includes rupture disc 316, in some embodiments, rupture disc 316 is not present in firing head 300.

FIG. 3' is a schematic, cross-sectional view of a firing head 301 of a perforating gun assembly similar to firing head 300 of FIG. 3 and deployable in the wellbore of FIG. 1. The perforating gun assembly of FIG. 3' includes first chamber 302, second chamber 304, energy storage element 306, spring 307, port 308, restrictor 309, firing pin 310, initiator 311, port 314, rupture disc 316, and firing pin interrupter 318, that are identical to first chamber 302, second chamber 304, energy storage element 306, spring 307, port 308, restrictor 309, firing pin 310, initiator 311, spring 313, port 314, rupture disc 316, and firing pin interrupter 318 as illustrated in FIG. 3, respectively, which are described in the paragraphs herein. Further, firing head 301 also includes another rupture disc 312 that is positioned between second chamber 304 and firing pin 310. In the embodiment of FIG. 3', rupture disc 312 is configured to rupture in response to a threshold pressure applied to the rupture disc 312 to prevent pressure from energy storage element 306 or the fluids in second chamber 304 from being prematurely applied to firing pin 310.

Figure 4:
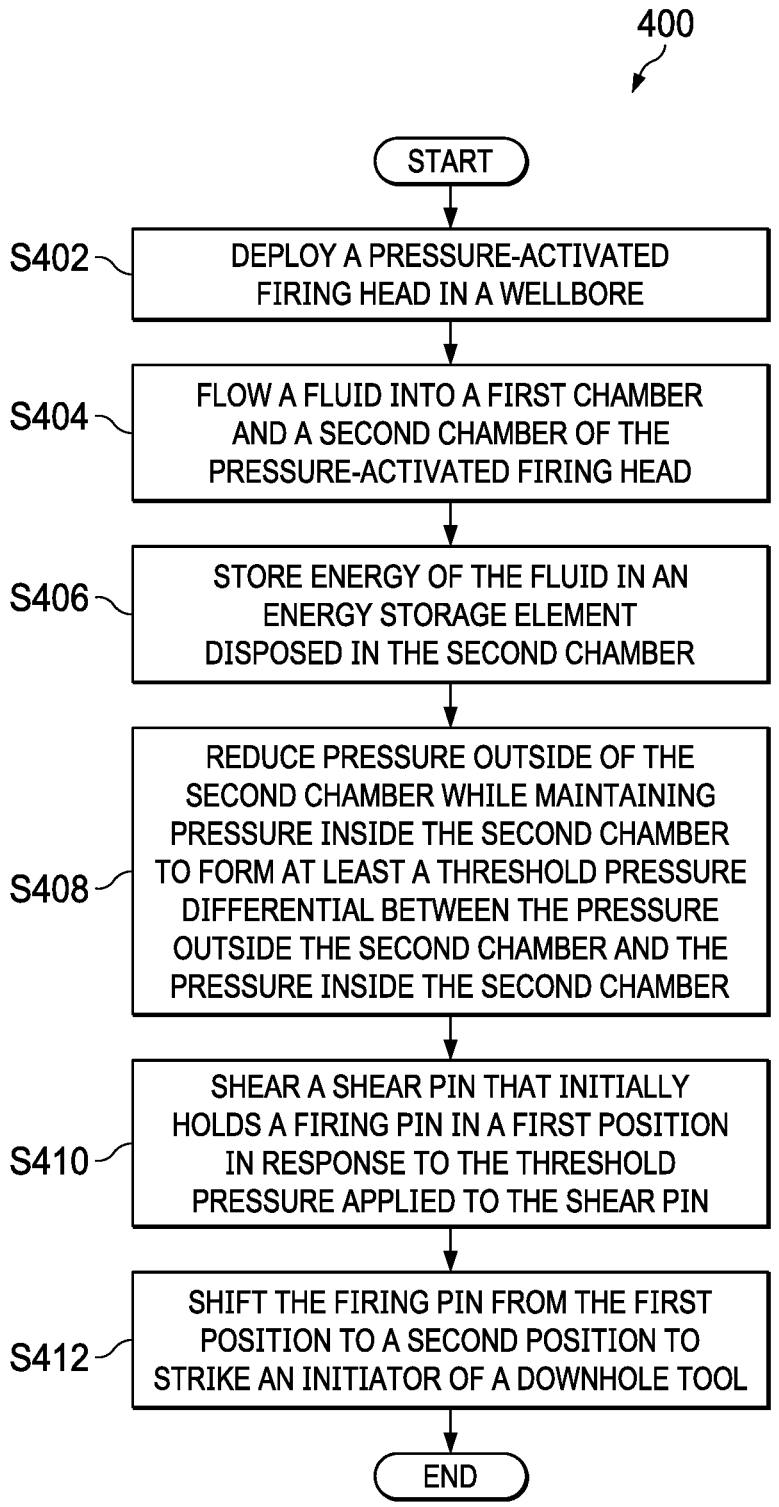
FIG. 4 is a flow chart of a process to set off a downhole explosion.

FIG. 4 is a flow chart 400 of a process to set off a downhole explosion, such as perforating gun assembly 119 of FIG. 1. Although the operations in the process 400 are shown in a particular sequence, certain operations may be performed in different sequences or at the same time where feasible.

At block S402, a pressure-activated firing head is deployed in a wellbore. FIG. 1 illustrates deploying perforating gun assembly 119 having a pressure-activated firing head in wellbore 116 of well 112. At block S404, fluid flows into a first chamber and a second chamber of the pressure-activated firing head. In that regard, FIG. 2A illustrates port 214, which provides fluid communication from an annulus outside of perforating gun assembly 119, such as annulus 148, to first chamber 202. FIG. 2A also illustrates port 208, which provides fluid communication from first chamber 202 to second chamber 204. Further, FIG. 2B illustrates after rupture disc 216 has ruptured, fluids flow from annulus 148 into first chamber 202, and from port 208 into second chamber 204. FIG. 2B also illustrates flow restrictor 209, which permits fluid flow through port 208 into second chamber 204, but restricts fluid flow from second chamber 204 via port 208 to first chamber 202.

At block S406, energy of the fluid is stored in an energy storage element disposed in the second chamber of the pressure-activated firing head. FIG. 2B illustrates spring 207 of energy storage element 206 in a compressed state to store energy of the fluids in second chamber 204. FIGS. 2A-2B also illustrate shifting of firing pin interrupter 218 from a first position illustrated in FIG. 2A, which restricts movement of firing pin 210, to a second position illustrated in FIG. 2B, which no longer restricts movement of firing pin 210 towards initiator 211 of FIGS. 2A and 2B.

At block S408, pressure outside of the second chamber is reduced while pressure inside the second chamber is maintained to form at least a threshold pressure differential between the pressure outside the second chamber and the pressure inside the second chamber. In that regard, in the embodiment of FIGS. 2A-2B, a pumping operation is performed to pump fluids outside of perforating gun assembly 119 of FIG. 1 to decrease pressure outside second chamber 204 of FIGS. 2A-2B. Fluids in first chamber 202 flow through port 214 into annulus 148 and are also pumped out. However, restrictor 209 of FIGS. 2A-2B prevents fluids in second chamber 204 from flowing out of pressure-activated firing head 200. As more and more fluids in first chamber 202 flow out of pressure-activated firing head 200 while fluids in second chamber 204 are restricted from flowing out of pressure-activated firing head 200, the pressure differential between pressure outside second chamber 204 and inside second chamber 204 increases until the pressure differential reaches a threshold differential. At block S410, a shearing pin that initially holds a firing pin in a first position is sheared in response to the threshold pressure applied to the shearing pin. In that regard, FIGS. 2A-2B illustrate firing pin retention members 215A and 215B (shear pins), which initially hold firing pin 210 in a position illustrated in FIG. 2A. Firing pin retention members 215A and 215B shear at the threshold pressure, thereby allowing fluid pressure on firing pin 210 to shift firing pin 210 from the position illustrated in FIG. 2A to strike initiator 211 of perforating gun assembly 119.

FIG. 2A' illustrates a rupture disc 212 positioned between second chamber 204 and firing pin 210. Further, rupture disc 212 is configured to rupture in response to the threshold pressure being applied to rupture disc 212, thereby allowing fluid pressure on firing pin 210 to shift firing pin 210 from the position illustrated in FIG. 2A' to strike initiator 211 of perforating gun assembly 119.

At block S412, a firing pin is shifted from a first position to a second position to strike an initiator of a downhole tool to initiate firing of the downhole tool. In the embodiment of FIG. 2B, and after firing pin retention members 215A and 215B have sheared, a force applied by fluids in second chamber 204 shifts firing pin 210 from the position illustrated in FIG. 2B towards initiator 211 to initiate firing of perforating gun assembly 119.

In the embodiment of FIG. 2A', and after rupture disc 212 has ruptured (not shown), a force applied by fluids in second chamber 204 shifts firing pin 210 from the position illustrated in FIG. 2B towards initiator 211 to initiate firing of perforating gun assembly 119.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flow chart depicts a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure:

Clause 1, a pressure-activated firing head, comprising: a first chamber; a second chamber having an energy storage element disposed within the second chamber; a port fluidly connecting the first chamber and the second chamber; a flow restrictor that restricts fluid flow from the second chamber to the first chamber; a firing pin shiftable from a first position to a second position to strike an initiator; and a shear pin that holds the firing pin in the first position and configured to shear in response to a threshold pressure applied to the shear pin to release the firing pin from the first position.

Clause 2, the pressure-activated firing head of clause 1, further comprising: a second port that provides fluid communication from an annulus outside of the pressure-activated firing head to the first chamber; and a rupture disc that covers the second port to prevent fluid communication from the annulus to the port, wherein the rupture disc is configured to rupture in response to a second threshold pressure applied to the rupture disc.

Clause 3, the pressure-activated firing head of clause 2, further comprising a firing pin interrupter that is disposed in the first chamber and shiftable from a first position to a second position, wherein the firing pin interrupter prevents movement of the firing pin while the firing pin interrupter is in the first position, and wherein the firing pin interrupter permits movement of the firing pin while the firing pin interrupter is in the second position.

Clause 4, the pressure-activated firing head of clause 3, further comprising: a third port that provides fluid communication to the annulus; a fourth port that fluidly connects to the first chamber; and a fifth port that fluidly connects to the second chamber.

Clause 5, the pressure-activated firing head of clause 4, further comprising a sleeve shiftable from a first position to a second position, wherein the sleeve covers the third port, the fourth port, and the fifth port while the sleeve is in the first position, and wherein the sleeve uncovers the third port, the fourth port, and the fifth port while the sleeve is in the second position.

Clause 6, the pressure-activated firing head of clause 5, wherein after the sleeve shifts to the second position, the firing pin interrupter is shiftable from the second position back to the first position.

Clause 7, the pressure-activated firing head of clause 6, further comprising a seat that is coupled to the sleeve and configured to catch a diverter deployed into an interior of the pressure-activated firing head.

Clause 8, the pressure-activated firing head of any of clauses 1-7, wherein the energy storage element comprises: a piston; and a spring coupled to the piston, wherein the spring is compressible to store energy and decompressible to release stored energy.

Clause 9, a method to set off a downhole explosion, comprising: deploying a pressure-activated firing head in a wellbore; flowing a fluid into a first chamber and a second chamber of the pressure-activated firing head; storing energy of the fluid in an energy storage element disposed in the second chamber; reducing pressure outside of the second chamber while maintaining pressure inside the second chamber to form at least a threshold pressure differential between the pressure outside the second chamber and the pressure inside the second chamber; shearing a shear pin that initially holds a firing pin in a first position in response to the threshold pressure applied to the shear pin; and shifting the firing pin from the first position to a second position to strike an initiator of a downhole tool to initiate firing of the downhole tool.

Clause 10, the method of clause 9, wherein flowing fluid into the first chamber and the second chamber comprises: flowing the fluid from the first chamber through a port into the second chamber; and restricting fluid flow of the fluid through the port out of the second chamber.

Clause 11, the method of clause 10, wherein flowing fluid into the first chamber and the second chamber further comprises: puncturing a rupture disc that covers a second port that provides fluid communication from an annulus outside of the pressure-activated firing head to the first chamber; and flowing the fluid from the annulus through the second port into the first chamber.

Clause 12, the method of clause 11, wherein prior to shifting the firing pin from the first position to the second position of the firing pin, the method further comprises shifting a firing pin interrupter that is disposed in the first chamber from a first position to a second position to permit movement of the firing pin while the firing pin interrupter is in the second position.

Clause 13, the method of clause 12, further comprising shifting a sleeve from a first position to a second position of the sleeve to establish pressure equilibrium inside the second chamber and outside the second chamber.

Clause 14, the method of clause 13, further comprising: uncovering a third port to provide fluid communication to the annulus; uncovering a fourth port that is fluidly connected to the first chamber to establish fluid communication to the first chamber; and uncovering a fifth port that is fluidly connected to the second chamber to establish fluid communication to the second chamber, wherein shifting the sleeve from the first position to the second position uncovers the third port, the fourth port, and the fifth port.

Clause 15, the method of clause 14, further comprising after uncovering the fourth port, applying pressure through the fourth port to shift the firing pin interrupter from the second position back to the first position.

Clause 16, method of any of clauses 13-15, further comprising flowing a diverter into the pressure-activated firing head, wherein a force applied by landing of the diverter on a seat shifts the sleeve from the first position to the second position of the sleeve.

Clause 17, a perforating gun assembly, comprising: a first chamber; a second chamber having an energy storage element disposed within the second chamber; a port disposed between the first chamber and the second chamber and fluidly connecting the first chamber and the second chamber; a restrictor that restricts fluid flow from the second chamber to the first chamber; an initiator; a firing pin shiftable from a first position to a second position to strike the initiator; and a rupture disc positioned between the second chamber and the firing pin and configured to rupture in response to a threshold pressure applied to the rupture disc.

Clause 18, the perforating gun assembly of clause 17, further comprising: a second port that provides fluid communication from an annulus outside of the perforating gun assembly to the first chamber; and a second rupture disc that covers the second port to prevent fluid communication from the annulus to the port, wherein the second rupture disc is configured to rupture in response to a second threshold pressure applied to the rupture disc.

Clause 19, the pressure-activated gun assembly of clause 18, further comprising a firing pin interrupter that is disposed in the first chamber and shiftable from a first position to a second position, wherein the firing pin interrupter prevents movement of the firing pin while the firing pin interrupter is in the first position, and wherein the firing pin interrupter permits movement of the firing pin while the firing pin interrupter is in the second position.

Clause 20, the pressure-activated gun assembly of clauses 18 or 19, further comprising: a third port that provides fluid communication to the annulus; a fourth port that fluidly connects to the first chamber; a fifth port that fluidly connects to the second chamber; and a sleeve shiftable from a first position to a second position, wherein the sleeve covers the third port, the fourth port, and the fifth port while the sleeve is in the first position, and wherein the sleeve uncovers the third port, the fourth port, and the fifth port while the sleeve is in the second position.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A pressure-activated firing head, comprising:

a first chamber;

a second chamber having an energy storage element disposed within the second chamber;

a port fluidly connecting the first chamber and the second chamber;

a flow restrictor that restricts fluid flow from the second chamber to the first chamber;

a firing pin shiftable from a first position to a second position to strike an initiator; and a shear pin that holds the firing pin in the first position and configured to shear in response to a threshold pressure applied to the shear pin to release the firing pin from the first position, wherein a portion of the firing pin is positioned in between the first chamber and the second chamber while the firing pin is in the first position, and wherein the firing pin shifts downwards and into the first chamber as the firing pin shifts from the first position to the second position.

2. The pressure-activated firing head of claim 1, further comprising:

a second port that provides fluid communication from an annulus outside of the pressure-activated firing head to the first chamber; and a rupture disc that covers the second port to prevent fluid communication from the annulus to the port, wherein the rupture disc is configured to rupture in response to a second threshold pressure applied to the rupture disc.

3. The pressure-activated firing head of claim 2, further comprising a firing pin interrupter that is disposed in the first chamber and shiftable from a first position to a second position, wherein the firing pin interrupter prevents movement of the firing pin while the firing pin interrupter is in the first position, and wherein the firing pin interrupter permits movement of the firing pin while the firing pin interrupter is in the second position.

4. The pressure-activated firing head of claim 3, further comprising:

a third port that provides fluid communication to the annulus;

a fourth port that fluidly connects to the first chamber; and a fifth port that fluidly connects to the second chamber.

5. The pressure-activated firing head of claim 4, further comprising a sleeve shiftable from a first position to a second position, wherein the sleeve covers the third port, the fourth port, and the fifth port while the sleeve is in the first position, and wherein the sleeve uncovers the third port, the fourth port, and the fifth port while the sleeve is in the second position.

6. The pressure-activated firing head of claim 5, wherein after the sleeve shifts to the second position, the firing pin interrupter is shiftable from the second position back to the first position.

7. The pressure-activated firing head of claim 6, further comprising a seat that is coupled to the sleeve and configured to catch a diverter deployed into an interior of the pressure-activated firing head.

8. The pressure-activated firing head of claim 1, wherein the energy storage element comprises:

a piston; and a spring coupled to the piston, wherein the spring is compressible to store energy and decompressible to release stored energy.

9. A method to set off a downhole explosion, comprising:

deploying a pressure-activated firing head in a wellbore;

flowing a fluid into a first chamber and a second chamber of the pressure-activated firing head;

storing energy of the fluid in an energy storage element disposed in the second chamber;

reducing pressure outside of the second chamber while maintaining pressure inside the second chamber to form at least a threshold pressure differential between the pressure outside the second chamber and the pressure inside the second chamber;

shearing a shear pin that initially holds a firing pin in a first position in response to the threshold pressure applied to the shear pin; and shifting the firing pin from the first position to a second position to strike an initiator of a downhole tool to initiate firing of the downhole tool, wherein a portion of the firing pin is positioned in between the first chamber and the second chamber while the firing pin is in the first position, and wherein the firing pin shifts downwards and into the first chamber as the firing pin shifts from the first position to the second position.

10. The method of claim 9, wherein flowing fluid into the first chamber and the second chamber comprises:

flowing the fluid from the first chamber through a port into the second chamber; and restricting fluid flow of the fluid through the port out of the second chamber.

11. The method of claim 10, wherein flowing fluid into the first chamber and the second chamber further comprises:

puncturing a rupture disc that covers a second port that provides fluid communication from an annulus outside of the pressure-activated firing head to the first chamber; and flowing the fluid from the annulus through the second port into the first chamber.

12. The method of claim 11, wherein prior to shifting the firing pin from the first position to the second position of the firing pin, the method further comprises shifting a firing pin interrupter that is disposed in the first chamber from a first position to a second position to permit movement of the firing pin while the firing pin interrupter is in the second position.

13. The method of claim 12, further comprising shifting a sleeve from a first position to a second position of the sleeve to establish pressure equilibrium inside the second chamber and outside the second chamber.

14. The method of claim 13, further comprising:

uncovering a third port to provide fluid communication to the annulus;

uncovering a fourth port that is fluidly connected to the first chamber to establish fluid communication to the first chamber; and uncovering a fifth port that is fluidly connected to the second chamber to establish fluid communication to the second chamber, wherein shifting the sleeve from the first position to the second position uncovers the third port, the fourth port, and the fifth port.

15. The method of claim 14, further comprising after uncovering the fourth port, applying pressure through the fourth port to shift the firing pin interrupter from the second position back to the first position.

16. The method of claim 13, further comprising flowing a diverter into the pressure-activated firing head, wherein a force applied by landing of the diverter on a seat shifts the sleeve from the first position to the second position of the sleeve.

17. A perforating gun assembly, comprising:

a first chamber;

a second chamber having an energy storage element disposed within the second chamber;

a port disposed between the first chamber and the second chamber and fluidly connecting the first chamber and the second chamber;

a restrictor that restricts fluid flow from the second chamber to the first chamber;

an initiator;

a firing pin shiftable from a first position to a second position to strike the initiator; and a shear pin that holds the firing pin in the first position and configured to shear in response to a threshold pressure applied to the shear pin to release the firing pin from the first position, wherein a portion of the firing pin is positioned in between the first chamber and the second chamber while the firing pin is in the first position and wherein the firing pin shifts downwards and into the first chamber as the firing pin shifts from the first position to the second position.

18. The perforating gun assembly of claim 17, further comprising:

a second port that provides fluid communication from an annulus outside of the perforating gun assembly to the first chamber; and a rupture disc that covers the second port to prevent fluid communication from the annulus to the port, wherein the rupture disc is configured to rupture in response to a second threshold pressure applied to the rupture disc.

19. The pressure-activated gun assembly of claim 18, further comprising a firing pin interrupter that is disposed in the first chamber and shiftable from a first position to a second position, wherein the firing pin interrupter prevents movement of the firing pin while the firing pin interrupter is in the first position, and wherein the firing pin interrupter permits movement of the firing pin while the firing pin interrupter is in the second position.

20. The pressure-activated gun assembly of claim 18, further comprising:

a third port that provides fluid communication to the annulus;

a fourth port that fluidly connects to the first chamber;

a fifth port that fluidly connects to the second chamber; and a sleeve shiftable from a first position to a second position, wherein the sleeve covers the third port, the fourth port, and the fifth port while the sleeve is in the first position, and wherein the sleeve uncovers the third port, the fourth port, and the fifth port while the sleeve is in the second position.

* * * * *